US005410802A

United States Patent [19]

Buckley

[11] Patent Number: 5,410,802

[45] Date of Patent: May 2, 1995

[54] DEPTH ADJUSTMENT MECHANISM IN A TERMINAL INSERTION MACHINE

[75] Inventor: Richard A. Buckley, Camp Hill, Pa.

[73] Assignee: The Whitaker Corporation, Wilmington, Del.

[21] Appl. No.: 125,988

[22] Filed: Sep. 23, 1993

[51] Int. Cl.[6] ..... B23P 19/04; H01R 43/20

[52] U.S. Cl. ..... 29/748; 29/566.2; 29/758; 29/760

[58] Field of Search ..... 29/33 M, 564.5, 564.6, 29/566.2, 605, 735, 748, 750, 754, 747, 758, 759, 760, 837, 842; 227/93, 105; 269/903

[56] References Cited

U.S. PATENT DOCUMENTS

| | | | |
|---|---|---|---|
| Re. 28,119 | 8/1974 | Busler et al. | 29/566.2 X |
| 3,266,695 | 8/1966 | Cervenka et al. | 227/105 X |
| 3,556,382 | 1/1971 | Busler et al. | 227/105 X |
| 3,576,063 | 4/1971 | Bakermann | 29/566.2 X |
| 4,179,785 | 12/1979 | Brown | 29/564.6 X |
| 5,319,842 | 6/1994 | Buckley et al. | 29/566.2 |

FOREIGN PATENT DOCUMENTS

| | | | |
|---|---|---|---|
| 467451A | 1/1992 | European Pat. Off. | 29/605 |
| 230693 | 12/1985 | Germany | 29/566.2 |

*Primary Examiner*—Peter Dungba Vo

[57] ABSTRACT

A machine is disclosed for inserting terminals into cavities of a bobbin to terminate the ends of electrical windings. The machine includes a shear mechanism that separates the terminals from the carrier strip and then guides the terminals during insertion thereof by an insertion mechanism. The depth of insertion is grossly controlled by means of an adjustable stop screw while a fine adjusting mechanism is provided for precise depth control. The fine adjusting mechanism includes a movable carriage which is moved by an actuating cylinder and a tool holder which is carried by the carriage and, in addition, is movable with respect to the carriage. An insertion mechanism is attached to the tool holder. A wedge member is arranged between two opposing surfaces of the carriage and tool holder so that movement of the wedge member in one direction adjusts the mechanism for a deeper insertion while movement in the other direction adjusts the mechanism for a shallower insertion.

19 Claims, 5 Drawing Sheets

DEPTH ADJUSTMENT MECHANISM IN A TERMINAL INSERTION MACHINE

The present invention relates to machines for attaching a terminal to the end of magnet wire wound around a bobbin and inserting the terminal into a cavity in the bobbin, and more particularly, to a mechanism for fine adjusting the depth of insertion of the terminal.

BACKGROUND OF THE INVENTION

Existing machines for terminating the ends of electrical windings of bobbins must be able to accommodate different styles and types of terminals. In all cases the terminal is severed from the carrier strip by a cutting blade and then it is inserted into a terminal receiving cavity of the bobbin. During insertion, the cutting blade remains extended to guide the loose terminal. The depth of insertion is controlled by means of an adjustable stop, usually a screw having a lock nut for locking it in place once the adjustment is complete. The screw may either be threaded into the movable insertion carriage and abut against the machine frame or be threaded into the frame and abut against the movable carriage. Such an adjusting mechanism is usually satisfactory for controlling the depth of insertion to within about 0.010 inch. However, due to the trend toward smaller, high density equipment, the positioning of components becomes more critical. Such is the case with certain wire wound bobbins where the depth of insertion of the terminals must be controlled to within about 0.001 to 0.002 inch. In these situations the traditional stop screw is ineffective. What is needed is a fine adjusting mechanism that works in cooperation with the stop screw to allow very precise depth adjustments.

SUMMARY OF THE INVENTION

A machine for inserting a body into a cavity in a housing is disclosed. The machine includes a frame, a workstation for positioning the body adjacent the housing, insertion means operable for moving the body from the workstation into the cavity, and actuator means for effecting the operation of the insertion means. An adjustable stop is associated with the actuator means and is arranged to engage the frame for grossly limiting the depth of insertion so that the insertion means is operable for moving the body into the cavity only until the adjustable stop engages the frame. According to the present invention a fine adjusting mechanism couples the actuator means to the insertion means for fine adjusting the depth of insertion of the body into the cavity. A carriage is coupled to the actuator means and arranged to move in response thereto in a first direction toward the housing and in a second direction away therefrom. A tool holder is provided having the insertion means attached thereto. The tool holder is carried by the carriage and is arranged to selectively move with respect to the carriage in the first and second directions. An adjusting means is associated with both the carriage and the tool holder for selectively varying the distance therebetween so that when a portion of the adjusting means is moved in a third direction the tool holder moves a desired distance away from the carriage and when moved in a forth direction the tool holder moves a desired distance toward the carriage.

DESCRIPTION OF THE PREFERRED EMBODIMENT

Figure 1:
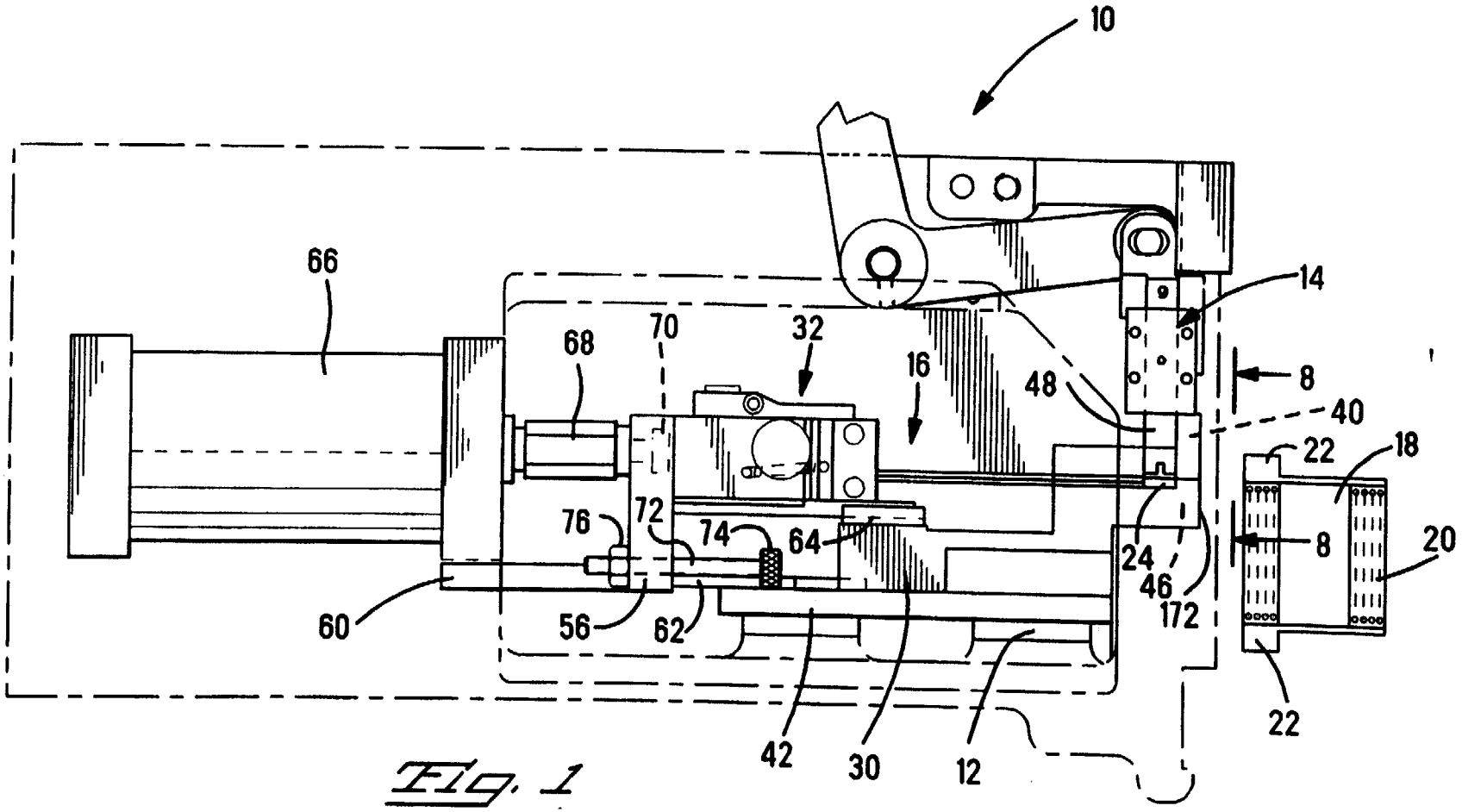
FIG. 1 is a side view of a terminal applicating machine incorporating the teachings of the present invention.

There is shown in FIG. 1 a machine 10 having a frame 12, a terminal shearing and guiding mechanism 14, and a terminal insertion mechanism 16, both of which are coupled to the frame. A typical bobbin 18 having an electrical winding 20 and terminal receiving cavities 22 is shown adjacent the machine 10 in position for receiving a terminal 24. The bobbin 18 is supported and positioned on tooling, not shown, that is specifically provided for each different bobbin application. The terminals 24 are provided in strip form in the usual manner, interconnected by segments of a carrier strip. Each terminal has an insulation displacement slot for receiving an end of the winding 20 and making electrical contact therewith.

Figure 2:
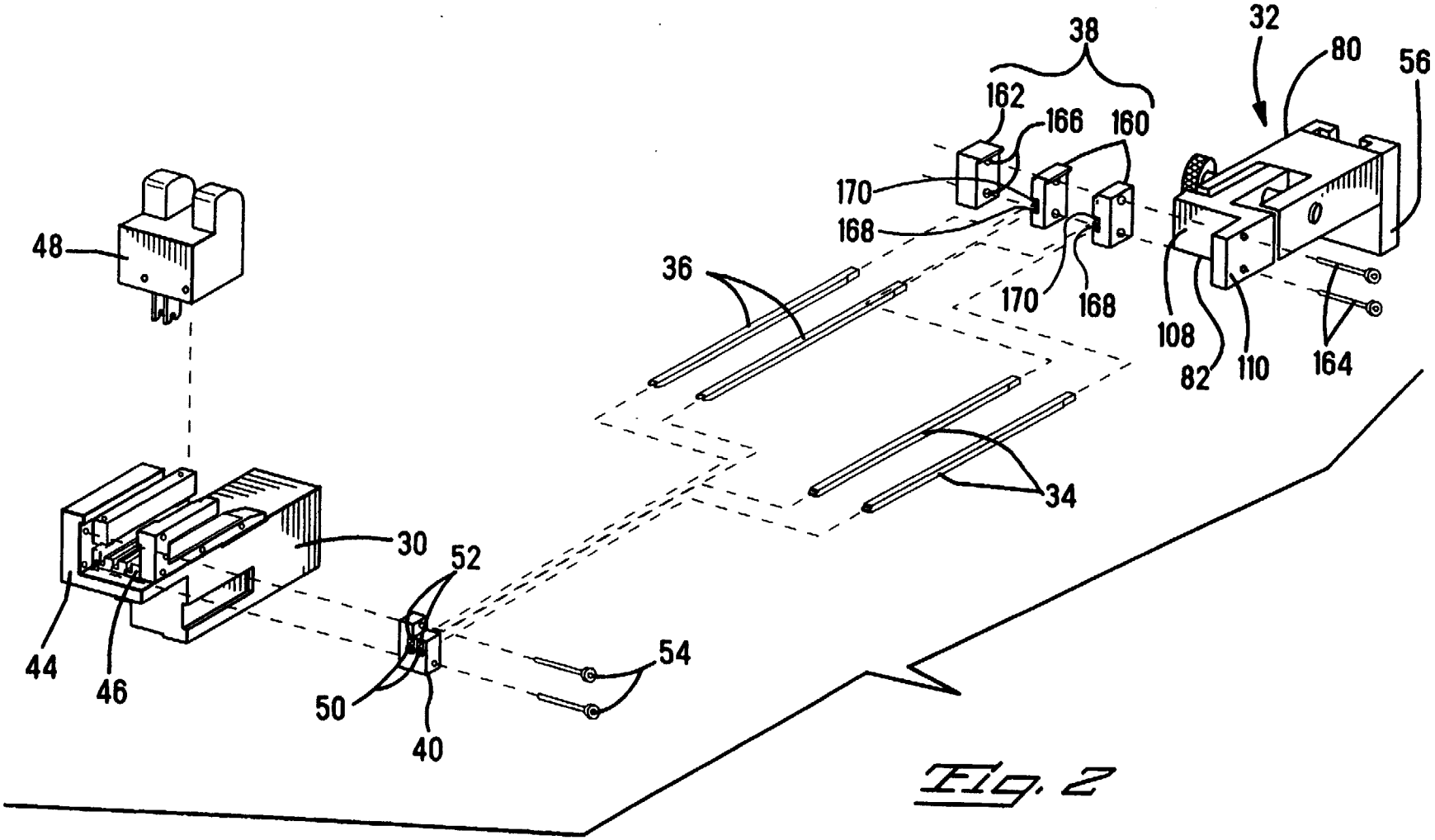
FIG. 2 is an exploded parts view showing portions of the insertion mechanism and the fine adjusting mechanism of the machine of FIG. 1.
Figure 3:
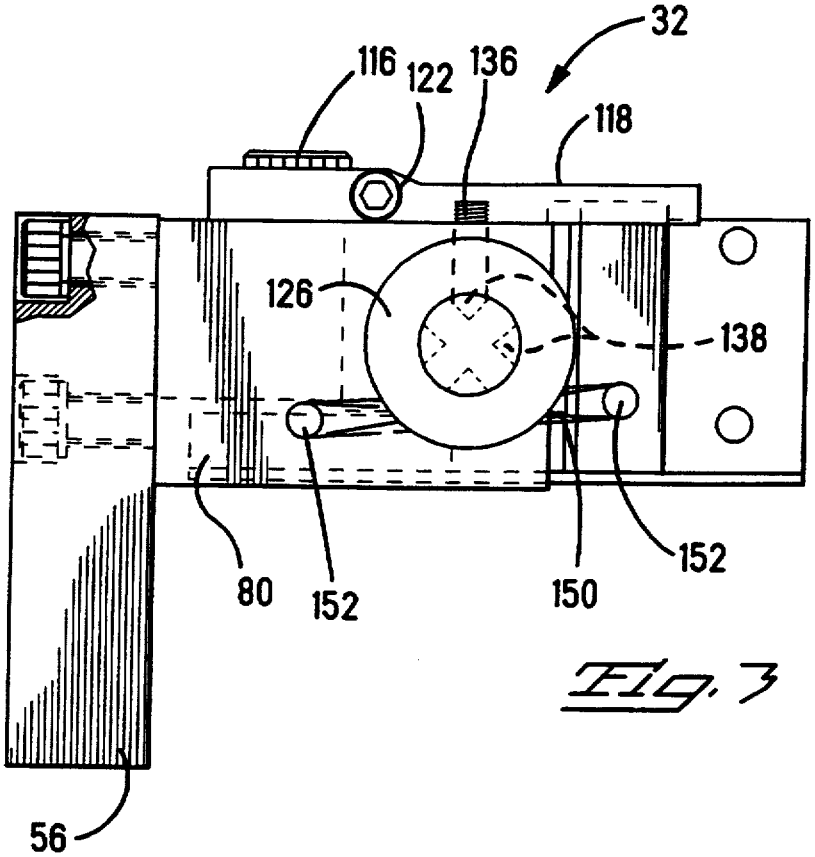
FIG. 3 is a front view of the fine adjusting mechanism shown in FIG. 1.
Figure 4:
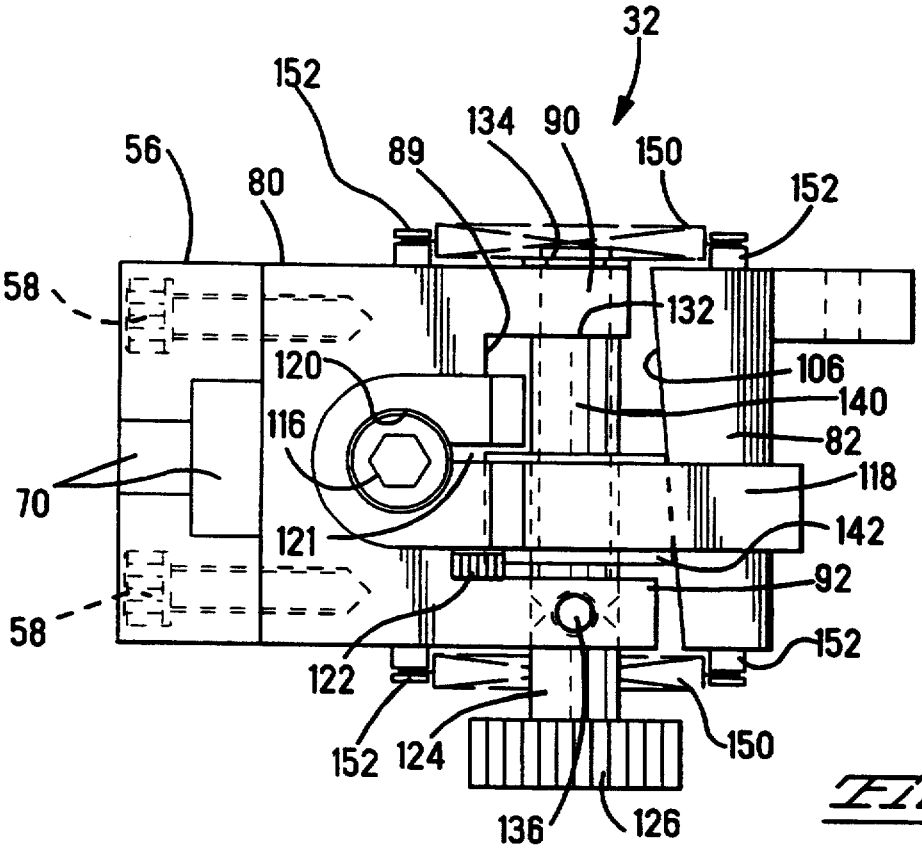
FIG. 4 is a top view of the fine adjusting mechanism.

The terminal insertion mechanism, as seen in FIGS. 1 and 2, includes a guide carriage 30, a fine adjusting mechanism 32, a pair of insertion blades 34 which comprise an insertion means, a pair of wire trim blades 36, a tooling block assembly 38 for attaching the blades to the fine adjusting mechanism, and a guide block 40. The guide carriage 30 is attached to the movable portion of a slide 42, which has its stationary portion attached to the frame 12 so that the guide carriage is free to move in first and second directions toward and away from the bobbin 18. The guide carriage 30 has an L-shaped nest 44 for receiving and positioning a die block assembly 46 which mates with a shear blade assembly 48 for severing the individual terminals from the carrier strip in the usual manner. The guide block 40 has four openings, therethrough, two lower openings 50 for receiving and guiding the two insertion blades 34 and two upper openings 52 for receiving and guiding the two wire trim blades. The guide block 40 is attached to the guide carriage 30 directly in front of the die block assembly 46 by means of two screws 54 that are threaded into holes in the carriage. As best seen in FIG. 1, the guide carriage 30 and the fine adjusting mechanism 32 are slidingly coupled together by means of a slide 64 which permits relative movement therebetween so that the two insertion blades and the two wire trim blades can be passed through the openings 50 and 52 respectively for inserting the terminal into the bobbin, trimming the ends of the wires, and then withdrawn. A coupling plate 56 is attached to an end of the fine adjusting mechanism by means of four screws 58,as shown in FIGS. 3 and 4. An air cylinder 60 has its housing attached to the coupling plate 56 and its piston rod 62 coupled to the guide carriage 30. In operation, the cylinder 60 is normally energized so that the piston rod 62 is in its extended position, as shown in FIG. 1. Therefore, the entire terminal insertion mechanism is free to move along the slide 42 in a first direction toward the bobbin 18 and in a second direction away from the bobbin. An air cylinder 66 is attached to the frame 12 and has its piston rod attached to the coupling plate 56 by means of a coupling 68 which engages a T-slot 70 formed in the top edge of the coupling plate. As best seen in FIG. 1 a stop screw 72 having a knurled head 74 is threaded into a threaded hole formed in the lower end of the coupling plate 56 so that the screw extends toward the guide carriage 30. The stop screw is arranged to abuttingly engage the guide carriage 30 to limit relative movement between the fine adjusting mechanism 32 and the guide carriage 30 via the slide 64, as will be explained below. This limited relative movement is adjustable by turning the screw further into or out of the threaded hole in the coupling plate 56, then locking it in place with the lock nut 76. By extending and retracting the piston rod of the air cylinder 66 the entire terminal insertion mechanism is made to move toward and away from the bobbin 18, as viewed in FIG. 1.

Figure 5:
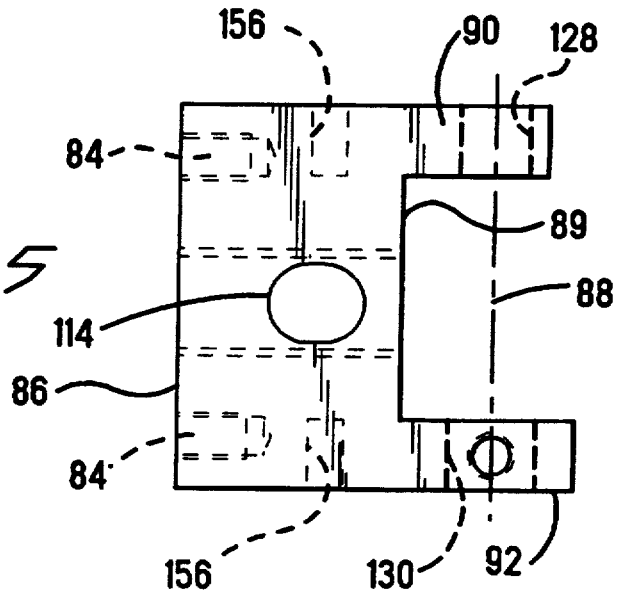
FIG. 5 is a plan view of the carriage shown in FIG. 4.
Figure 7:
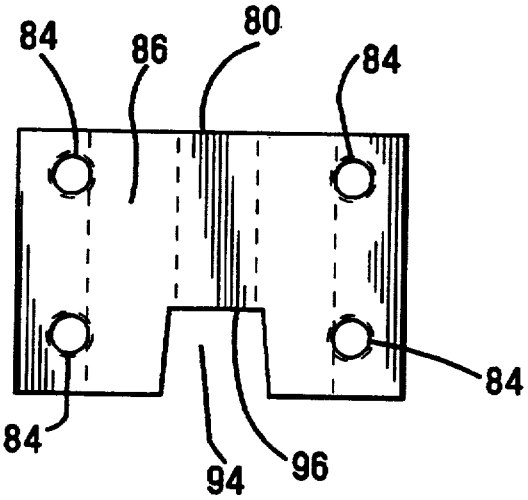
FIGS. 6 and 7 are front and side views respectively of the carriage shown in FIG. 5.
Figure 6:
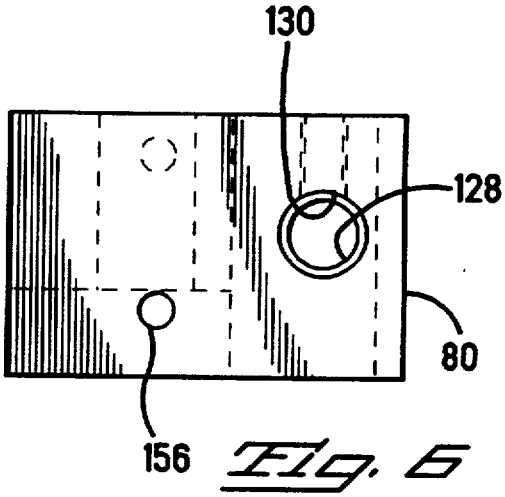
Figure 8:
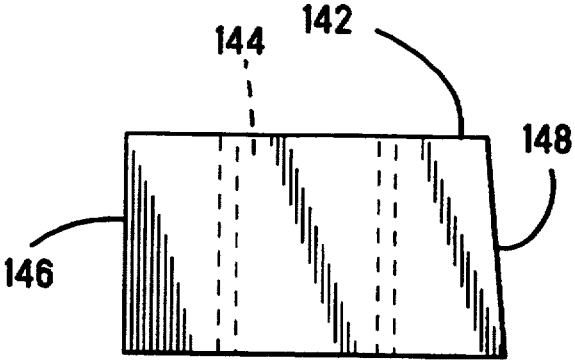
FIG. 8 is a plan view of the wedge member shown in FIG. 4.
Figure 12:
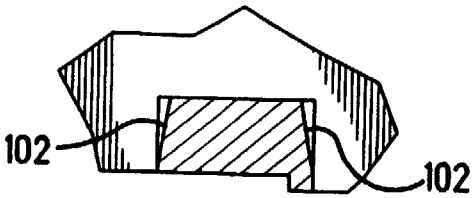
FIG. 12 is a cross-sectional view of a portion of the tool holder taken along the lines 12—12 of FIG. 10.
Figure 11:
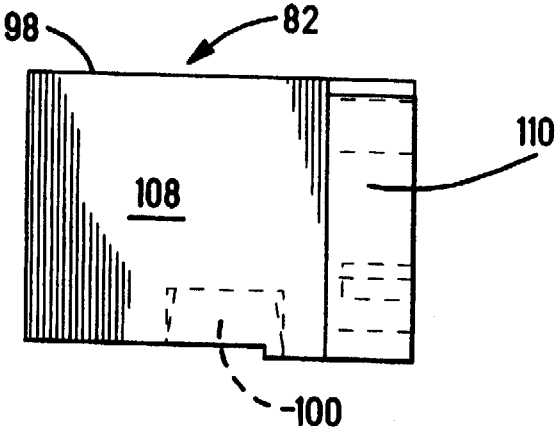
FIGS. 10 and 11 are front and side views respectively of the tool holder shown in FIG. 9.
Figure 9:
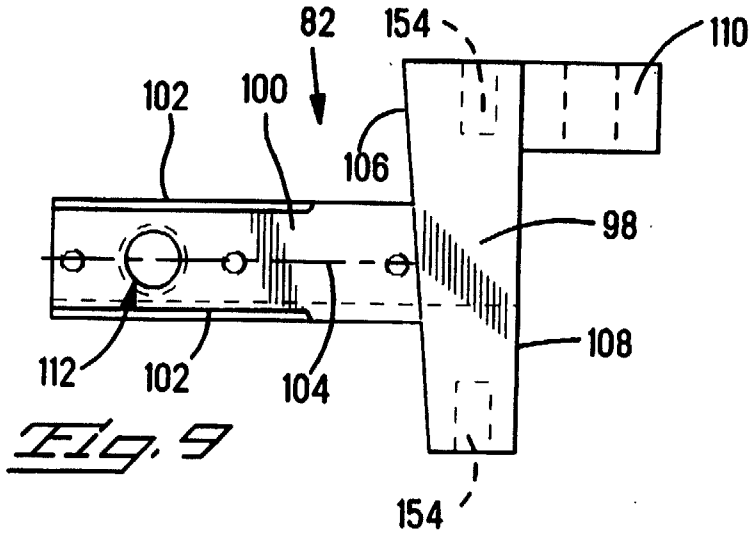
FIG. 9 is a plan view of the tool holder shown in FIG. 4.
Figure 10:
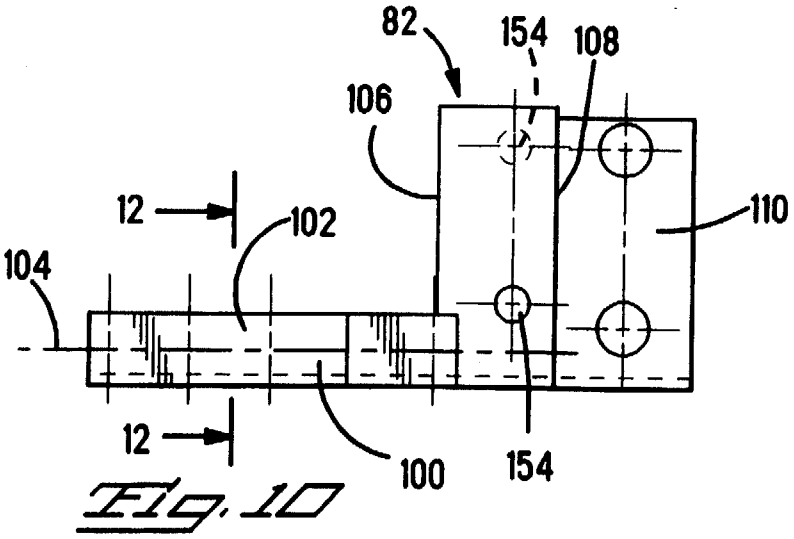

As best seen in FIGS. 3 and 4 the fine adjusting mechanism 32 includes a carriage 80 and a tool holder 82. The carriage 80, as shown in FIGS. 5, 6, and 7, has four threaded holes 84 in an end face 86 thereof for receiving the screws 58. The coupling plate 56 is secured against this end face 86 as shown in FIGS. 3 and 4. The carriage 80 has a cutout 88 formed in the end opposite the end 86 thereby forming a pair of flanges 90 and 92 and a banking surface 89 therebetween. A slot 94 is formed in the bottom surface of the carriage 80 and extends from the end 86 to the cutout 88. The side walls of the slot 94 are tapered inwardly toward the floor 96 of the slot so that each side wall formes an angle with the vertical of about 10 degrees. The tool holder 82, as shown in FIGS. 9, 10, and 11, includes a base 98 and an elongated arm 100 extending therefrom. The arm 100 includes side walls 102 that are tapered in correspondence with the tapered side walls of the slot 94 so that the arm is in sliding engagement with the slot. The arm 100 has a longitudinal axis 104 that is parallel with the first and second directions of movement of the terminal insertion mechanism. The tapered side walls aid in releasably locking the tool holder securely to the carriage during operation of the machine 10, as will be described below. The base 98 includes a facing surface 106 that is angled with respect to the axis 104 as viewed in FIG. 9 and is normal to the axis as viewed in FIG. 10. A flat surface 108 is provided opposite the angled facing surface 106 that is orthogonal to the axis 104. A flange 110 extends from the surface 108 at right angles thereto and is arranged to receive the tooling block assembly 38, which will be described below. A threaded hole 112 is formed in the arm 100 in alignment with an elongated hole 114 formed in the carriage and intersecting the slot 94. A screw 116, as seen in FIGS. 3 and 4, extends through the elongated hole 114 with clearance and into the threaded hole 112. When the screw 116 is loosened the arm 100 is free to slide along the slot 94 within the limits of the elongated hole 114. When the two parts are in a desired position they are locked together by tightening the screw 116 which pulls the arm 100 into the tapered side walls of the slot 94. The angle of the taper is selected so that the arm 100 will not stick to the tapered walls of the slot when the screw is loosened. To achieve this a taper of over about five degrees must be used. In the present example, as set forth above, ten degrees was used and found to be satisfactory. A locking lever 118 has a bore 120 that snugly surrounds the head of the screw 116, as shown in FIGS. 3 and 4. A slit 121 is formed in the lever so that it intersects the bore. A screw 122 extends through a clearance hole, through the slit 121, and into a threaded hole in the lever 118. By loosening the screw 122, the lever may be rotated to any convenient position and the screw again tightened, locking the locking lever to the screw 116. This provides a convenient lever for manually locking together and unlocking the carriage and tool holder. An adjusting shaft 124 having a knurled knob 126 is journaled for rotation in bores 128 and 130 in the flanges 90 and 92 respectively. The bore 128 is of smaller diameter than the bore 130 so that a shoulder 132 of the shaft can abut the side of the flange 90. A groove is formed in the smaller diameter of the shaft to accommodate a retaining ring 134 for holding the shaft captive to the carriage 80 and limiting axial movement thereof. A spring plunger 136 is arranged in the flange 92, as shown in FIGS. 3 and 4, so that it engages a cone-shaped depression 138 formed in the outer diameter of the shaft 124. In the present example there are four equally spaced depressions 138 thereby forming four detent points for each revolution of the shaft 124. The shaft 124 includes a threaded portion 140 between the two flanges 90 and 92. A wedge member 142, as shown in FIGS. 4 and 8, is disposed between the flanges 90 and 92 and has a threaded hole 144 formed therethrough in engagement with the threaded portion of the shaft 124. The wedge member 142 has a flat surface 146 that is parallel with the axis of the hole 144 and in sliding engagement with the banking surface 89 of the carriage 80. An angled surface 148 is formed on the wedge member opposite the surface 146 and is in sliding engagement with the facing surface 106 of the tool holder 82. As the shaft 124 is rotated counterclockwise, as viewed in FIG. 3, the wedge member 142 is made to move toward the flange 90 thereby forcing the facing surface 106 and the banking surface 89 apart. When the shaft 124 is rotated in the opposite direction, the wedge member 142 is made to move away from the flange 90 thereby allowing the facing surface 106 to move toward the banking surface 89 under the urging of a pair of extension springs 150. The springs 150 are attached to pins 152 that are pressed into holes 154 in opposite sides of the base 98 and holes 156 in opposite sides of the carriage 80. The angled surface 148 and the facing surface 106 are formed on an angle from the vertical, as viewed in FIG. 4, of five degrees. The threaded hole 144, in the present example, has 18 threads to the inch. This results in a relative movement of the facing and banking surfaces of 0.0048 inch for every rotation of the shaft 124. Therefore, every one quarter turn of the shaft, as indicated by the detent spring plunger 136, results in a relative movement of only 0.0012 inch.

The block assembly 38, as shown in FIG. 2, includes a pair of tool holders 160 and a clamping block 162, which are secured against the flange 110 by means of the screws 164 that engage threaded holes 166 formed in the clamping block. Each tool holder 160 has a pair of slots 168 and 170 sized to receive the ends of the terminal insertion blades 34 in the two lower slots 168 and the two wire trim blades 36 in the two upper slots 170. The depth of the slots 168,170 is less than the width of the blades so that when the screws 164 are tightened the blades 34 and 36 are rigidly clamped in place. The other ends of the blades 34 and 36 are aligned with the openings 50 and 52 respectively in the guide block 40.

The operation of the machine 10 will now be described with particular reference to FIGS. 1 and 2. The shearing mechanism 48 is positioned over the die block assembly 46 as shown in FIG. 1 with the cylinder 66 retracted and the cylinder 60 pressurized to its extended position. A bobbin 18 is arranged in position as shown in FIG. 1. A strip of terminals is loaded into the machine so that a pair of terminals 24 are in position over the die block assembly 46. While the cylinder 60 is pressurized and its piston rod remains extended, the air cylinder 66 is pressurized causing the fine adjusting mechanism 32 and the guide carriage 30 to move along the slide 42 toward the bobbin 18, as best seen in FIG. 1. This movement continues until the faces 172 of the guide carriage 30 and the guide block 40 engage the face of the bobbin 18 and stop further movement of the carriage 30. However, since the air cylinder 66 is larger than the cylinder 60, the smaller one is overpowered allowing the fine adjusting mechanism 32 to move with respect to the guide carriage 30 along the slide 64. This carries the terminal insertion blades 34 and the wire trim blades 36 forward, picking up the two terminals and pushing them toward and into the openings 50 of the guide block 40, through the guide block and into the terminal receiving cavities 22 of the bobbin 18. As the terminals seat in the cavities 22 the ends of the windings 20 are forced into the insulation displacement slots of the terminals and the wire trim blades 36 trim off the excess wire ends. The pressurization of the air cylinder 66 is then reversed and the fine adjustment mechanism 32 withdrawn, thereby withdrawing the blades 34 and 36 to their original starting position relative to the guide carriage 30 as the guide carriage is held in engagement with the bobbin 18 by the air cylinder 60. As the cylinder 66 continues to retract, the cylinder 60 reaches its full extension allowing the guide carriage 30 to withdraw away from the bobbin and both the fine adjusting mechanism 32 and the guide carriage 30 return to their initial positions shown in FIG. 1.

As set forth above, the depth of insertion of the terminals 24 in the cavity 22 is controlled by two mechanisms. The stop screw 72 is adjusted to bring the terminals to within about 0.010 inch of their proper depth. A trial insertion is performed and the resulting insertion depth is measured. The fine adjusting mechanism is then manipulated to bring the insertion depth to within about 0.001 inch of the proper depth. This is accomplished by rotating the lever 118 counterclockwise, as viewed in FIG. 4, to unlock the arm 100 of the tool holder 82 so that the arm is free to slide within the slot 94. The knob 126 is then manually rotated to rotate the shaft 124 in the desired direction so that the wedge member 142 moves the facing surface 106 of the tool holder 82 in the first or second directions along the axis 104 the desired amount. The lever 118 is then rotated clockwise to pull the arm 100 into the tapered slot 94 thereby securely locking the tool holder 82 in position with respect to the carriage 80. This procedure may be repeated any number of times until the desired results are achieved.

An important advantage of the present invention is that the two tier depth adjusting system, the adjustable stop screw and the fine adjusting mechanism combine to provide precise control over the depth of terminal insertion not before realized. Further, the unique tapered arm and slot arrangement and the sliding wedge member form a structure that is adjustable yet directs the insertion forces through in-line abutting surfaces, rather than through screw threads of adjusting screws. Additionally, the fine adjusting mechanism structure is relatively simple to manufacture.

I claim:

1. In a machine for inserting a body into a cavity in a housing, wherein said machine has a frame, a workstation for positioning said body adjacent said housing, insertion means operable for moving said body from said workstation into said cavity, and actuator means for effecting operation of said insertion means, a depth adjustment mechanism for controlling a depth of insertion of said body into said cavity, comprising:

an adjustable stop associated with said actuator means and arranged to engage said frame for grossly limiting the depth of insertion wherein said insertion means is operable for moving said body into said cavity only until said adjustable stop engages said frame: and, a fine adjusting mechanism coupling said actuator means to said insertion means for fine adjusting the depth of insertion of said body into said cavity, wherein said fine adjusting mechanism includes:

(a) a carriage coupled to said actuator means and arranged to move in response thereto in a first direction toward said housing and in a second direction away therefrom;

(b) a tool holder having said insertion means attached thereto, said tool holder carried by said carriage and arranged for selective movement with respect to said carriage in said first and second directions: and, (c) adjusting means associated with both said carriage and said tool holder for effecting said selective movement of said tool holder, thereby selectively varying a distance between said carriage and said tool holder.

2. The depth adjustment mechanism according to claim 1 wherein said carriage includes a slot having a longitudinal axis that is parallel with said first and second directions and said tool holder includes an elongated arm in sliding engagement with said slot for guiding said tool holder during said selective movement with respect to said carriage.

3. The depth adjustment mechanism according to claim 2 including a slide having a stationary member attached to said frame and a movable member attached to said elongated arm so that said carriage and said tool holder are free to move in said first and second directions.

4. The depth adjustment mechanism according to claim 3 wherein said slot has walls that taper inwardly toward the bottom thereof and said elongated arm has side walls that taper in correspondence with the taper of said walls of said slot, including means for urging said tapered elongated arm into said tapered slot thereby locking said tool holder securely to said carriage for inhibiting said selective movement.

5. The depth adjustment mechanism according to claim 4 wherein said tapered walls are tapered to an angle of more than about five degrees.

6. The depth adjustment mechanism according to claim 5 wherein said means for urging includes a screw extending through a clearance opening in said carriage and into threaded engagement with a threaded hole in said elongated arm.

7. The depth adjustment mechanism according to claim 6 wherein said means for urging includes a lever attached to the head of said screw and arranged for manual rotation of said screw in one direction for effecting said locking of said tool holder to said carriage and in the other direction for unlocking said tool holder from said carriage thereby enabling said selective movement.

8. The depth adjustment mechanism according to claim 1 wherein said adjusting means comprises:

(a) a banking surface on said carriage and a facing surface on said tool holder opposed to said banking surface wherein one of said banking surface and said facing surface is substantially orthogonal to said first and second directions and the other is angled with respect thereto;

(b) resilient means for urging said facing surface of said tool holder toward said banking surface of said carriage;

(c) a member disposed between said carriage and said tool holder and held in engagement with said banking and facing surfaces by said resilient means so that when said member is moved in a third direction, said tool holder moves away from said carriage and when moved in a fourth direction said tool holder moves toward said carriage under the urging of said resilient means; and (d) means for moving said member in said third and forth directions.

9. The depth adjustment mechanism according to claim 8 wherein said banking surface is orthogonal to said first and second directions and said facing surface is angled with respect thereto.

10. The depth adjustment mechanism according to claim 9 wherein said member is a wedge having a surface in engagement with said banking surface and another surface opposite thereto that is angled in correspondence to and in engagement with said facing surface.

11. The depth adjustment mechanism according to claim 10 wherein said means for moving said member includes a shaft journaled for rotation in said carriage so that its axis is normal to said first and second directions and having a threaded portion in threaded engagement with said wedge.

12. The depth adjustment mechanism according to claim 11 wherein said carriage includes a pair of spaced flanges extending from one end thereof and wherein said wedge in disposed between said flanges and said shaft is journaled in said flanges.

13. The depth adjustment mechanism according to claim 12 wherein said shaft includes a shoulder against one side of one of said flanges and a groove containing a retaining ring against the other side thereby limiting axial movement of said shaft with respect to said carriage.

14. The depth adjustment mechanism according to claim 13 wherein said shaft includes a knob for manual rotation thereof and a detent that indicates desired amounts of said rotation.

15. In a machine for inserting a body into a cavity in a housing, wherein said machine has a frame, a workstation for positioning said body adjacent said housing, insertion means movable along a path through said workstation and toward said housing for moving said body from said workstation into said cavity, and actuator means coupled to said frame and operable for effecting relative movement of said insertion means along said path, a depth adjustment mechanism for controlling a depth of insertion of said body into said cavity, comprising:

a gross adjusting mechanism including an adjustable stop associated with said actuator means for selectively limiting said relative movement of said insertion means along said path; and, a fine adjusting mechanism coupled between said actuator means and said insertion means for selectively adjusting an initial position of said insertion means along said path, wherein said depth of insertion is a function of both said initial position and said relative movement.

16. The depth adjustment mechanism according to claim 15, wherein said fine adjusting mechanism comprises:

a carriage coupled to said actuator means and arranged to move in response thereto in a first direction toward said housing and in a second direction away therefrom, said first and second directions being parallel to said path;

a tool holder carried by said carriage and having said insertion means attached thereto, said tool holder being arranged for selective movement with respect to said carriage in said first and second directions; and, adjusting means associated with both said carriage and said tool holder for effecting said selective movement, thereby enabling selective variation of a distance between said carriage and said tool holder.

17. The depth adjustment mechanism according to claim 16, wherein said adjusting means comprises:

a banking surface on said carriage and a facing surface on said tool holder opposed to said banking surface wherein one of said banking surface and said facing surface is substantially orthogonal to said first and second directions and the other is angled with respect thereto;

resilient means for urging said facing surface of said tool holder toward said banking surface of said carriage;

a member disposed between said carriage and said tool holder and held in engagement with said banking and facing surfaces by said resilient means so that when said member is moved in a third direction, said tool holder moves away from said carriage and when moved in a fourth direction said tool holder moves toward said carriage under the urging of said resilient means; and means for moving said member in said third and forth directions.

18. The depth adjustment mechanism according to claim 17 wherein said member is a wedge having a pair of surfaces each in engagement with a respective one of said banking and facing surfaces.

19. The depth adjustment mechanism according to claim 18 wherein said means for moving said member includes a shaft journaled for rotation in said carriage so that its axis is normal to said first and second directions and having a threaded portion in threaded engagement with said wedge.

* * * * *